US008028710B2

(12) United States Patent
Stine

(10) Patent No.: US 8,028,710 B2
(45) Date of Patent: Oct. 4, 2011

(54) WATER-POWERED HAND-WASHING SYSTEM AND METHOD

(76) Inventor: Patrick Stine, Whiting, VT (US)

( * ) Notice: Subject to any disclaimer, the term of this patent is extended or adjusted under 35 U.S.C. 154(b) by 165 days.

(21) Appl. No.: 12/371,673

(22) Filed: Feb. 16, 2009

(65) Prior Publication Data

US 2009/0293913 A1 Dec. 3, 2009

Related U.S. Application Data

(60) Provisional application No. 61/056,546, filed on May 28, 2008.

(51) Int. Cl.
*B08B 3/02* (2006.01)

(52) U.S. Cl. ..... 134/198

(58) Field of Classification Search ..... 134/56 R, 134/104.2, 182, 198, 200, 201
See application file for complete search history.

(56) References Cited

U.S. PATENT DOCUMENTS

| | | | | |
|---|---|---|---|---|
| 3,982,965 | A | 9/1976 | Spotz | |
| 4,020,856 | A * | 5/1977 | Masterson | 132/74.5 |
| 4,119,439 | A | 10/1978 | Boucher | |
| 4,137,929 | A | 2/1979 | Grossman | |
| 4,289,152 | A | 9/1981 | Fuhre | |
| 4,635,656 | A | 1/1987 | Daniel | |
| 4,742,836 | A | 5/1988 | Buehler | |
| 5,193,563 | A * | 3/1993 | Melech | 134/100.1 |
| 5,713,378 | A | 2/1998 | Smith | |
| 5,755,240 | A | 5/1998 | Schonborn | |
| 5,823,447 | A | 10/1998 | Maybach | |
| 6,176,941 | B1 * | 1/2001 | Jewett et al. | 134/29 |
| 6,431,189 | B1 * | 8/2002 | Deibert | 134/57 R |
| 2009/0299787 | A1 | 12/2009 | Barnhill | |

FOREIGN PATENT DOCUMENTS

| | | |
|---|---|---|
| EP | 0389884 | * 10/1990 |
| FR | 2758445 | 7/1998 |

OTHER PUBLICATIONS

Meritech, 500EZ Product Information Sheet, wwww.meritech.com/products/500/index.php.

* cited by examiner

*Primary Examiner* — Joseph L Perrin
(74) *Attorney, Agent, or Firm* — Downs Rachlin Martin PLLC

(57) ABSTRACT

A hand-washing system for washing fingernail beds and cuticular regions of human fingers and thumbs (collectively "digits"). The hand-washing system includes a work enclosure for containing ones of the digits and a high-velocity, high-flow water spray during a washing operation. The work enclosure defines an interior space, part of which defines an energy-dissipation region that, during use, provides a water reservoir for dissipating energy in the high-velocity, high flow water spray. The work enclosure includes a high-energy spray nozzle and a digit portal sized to receive the four fingers of one hand simultaneously in closed-fingered, upwardly-curled configuration. A mixing valve may be provided to allow a user to adjust the temperature of the water during washing. A quick-disconnect fluid-coupling assembly may also be provided and be used to quickly select between work enclosures of differing size.

26 Claims, 3 Drawing Sheets

WATER-POWERED HAND-WASHING SYSTEM AND METHOD

RELATED APPLICATION DATA

This application claims the benefit of priority of U.S. Provisional Patent Application Ser. No. 61/056,546, filed on May 28, 2008, and titled "Water-Powered Handwasher And Hand-Washing Method," which is incorporated by reference herein in its entirety.

FIELD OF THE INVENTION

The present invention generally relates to the field of personal hygiene. In particular, the present invention is directed to a water-powered hand-washing system and method.

BACKGROUND

All human surfaces harbor bacteria; some have favorite places. Certain forms of non-pathogenic streptococci limit their homesites to the first millimeter of oral mucosa at the gumline. Common forms of staphylococcus are found in a third of asymptomatic noses. By virtue of their role in touching public items, procuring food, picking noses, satisfying itches and handling-the-paper chores, the thumb and first two fingers probably provide the greatest sample and volume of bacteria from the daily environment. If those digits carry pathogenic *E. coli, Salmonella* or methicillin-resistant *Staph aureus* (MRSA), you may have a major health problem. If they invite more ordinary bacteria and viruses to the kitchen and dinner table, you may just get sick for a few days.

One way to stay healthy is to reduce the bacterial count on the hands. It is impossible, even with a ten-minute surgical scrub, to eliminate all of them. A unique problem exists in the nail beds, where accumulated oil and dirt may provide a refuge for bacteria and be hard to displace. Soaps and detergents act in two ways. Their main role is to cut the grease and soften the buildup under the nails and in the cuticles. They may also directly injure the cell membranes of bacteria, affecting their mobility or even killing them. Soaps and detergents require sufficient time and concentration at the work site to be effective.

Commonly used bactericidal chemicals intended for use on skin, for example, antiseptics, include iodine and mercury compounds, phenol, alcohol, benzalkonium chloride, mineral spirits, propylene glycol, chlorhexidine and hexachlorophine. Their role in routine hand cleaning is limited by their potential to irritate skin.

A number of devices have been developed over the years for assisting in the cleaning of fingertips, particularly the hard-to-clean nail beds and cuticles. However, each of these devices has at least one drawback, ranging from low cleaning efficiency to difficulty in cleaning the device between uses, among others.

SUMMARY OF THE DISCLOSURE

In a first implementation, the present disclosure is directed to a hand-washing system powered by water. The hand-washing system includes: a work enclosure that includes: an upper end when the work enclosure is in use; a lower end when the work enclosure is in use, the lower end spaced from the upper end; a longitudinal central axis extending between the upper end and the lower end; a sidewall extending between the upper end and the lower end; a closure substantially closing the lower end; an interior space substantially defined by the sidewall and the closure; and a spray nozzle located at the upper end, the spray nozzle having an inlet, an inlet water pressure at the inlet during use, and a spray exit orifice configured to provide a spray of water at an outlet flow rate (Q) and a nozzle exit velocity (V) during use, the spray nozzle configured so that 1) the outlet flow rate is at least 0.7 gallons per minute when the inlet water pressure is 20 pounds per square inch and 2) the spray nozzle has a V/Q ratio of at least 20 gallons-per-minute per feet-per-second, wherein the spray exit orifice is oriented to direct the spray of water into the interior space; wherein the sidewall contains a digit portal receiving at least one digit of a hand of a human user during use and configured to allow the human user to point the at least one digit toward the upper end during use of the hand-washing system.

In a second implementation, the present disclosure is directed to a hand-washing system. The hand-washing system includes: a first work enclosure arranged according to the work enclosure of the first implementation and configured to be optimized for a first hand of a first size, the first work enclosure including a first quick-disconnect coupling; a second work enclosure arranged according to the work enclosure of the first implementation and configured to be optimized for a second hand of a second size different from the first size of the first hand, the second work enclosure including a second quick-disconnect coupling; a mixing valve for receiving hot and cold water and mixing the hot and cold water into a controlled-temperature mixture; a third quick-disconnect coupling; and a flexible conduit fluidly connecting the third quick-disconnect coupling to the mixing valve; wherein each of the first and second quick-disconnect couplings is configured to fluidly couple, in seriatim, corresponding respective ones of the first and second work enclosures to the third quick-disconnect coupling so as provide the controlled temperature mixture thereto.

In a third implementation, the present disclosure is directed to a water-powered hand-washing system for washing digits of a hand including four contiguous three-phalanx fingers and an opposing thumb. The water-powered hand-washing system includes: a work enclosure that includes: an upper end when the hand-washing system is in use; a lower end when the hand-washing system is in use, the lower end spaced from the upper end; a longitudinal central axis extending between the upper end and the lower end; a sidewall extending between the upper end and the lower end; a closure substantially closing the lower end; an interior space substantially defined by the sidewall and the closure; and a spray nozzle located at the upper end, the spray nozzle having an inlet, an inlet water pressure at the inlet, and a spray exit orifice configured to provide a spray of water at an outlet flow rate (Q) and a nozzle exit velocity (V), the spray nozzle configured so that the outlet flow rate is at least 1.5 gallons per minute when the inlet water pressure is 40 pounds per square inch and the spray nozzle has a V/Q ratio of at least 30 gallons-per-minute per feet-per-second, wherein the spray exit orifice is oriented to direct the spray of water into the interior space, the spray nozzle configured to provide a fan-shaped spray having an included angle of at least 25°; wherein the sidewall contains a digit portal spaced from the closure so as to define an energy dissipation region for containing a reservoir of water for dissipating energy in the spray of water when the hand-washing system is operating in an upright position with the upper end located above the lower end, the digit portal having a laterally elongate finger receiving-region for receiving simultaneously the four three-phalanx fingers in a closed-fingered, upwardly curled arrangement, and further having a thumb notch extending toward the upper end of the work enclosure, the thumb notch for receiving the thumb in an orientation that allows the human user to point the tip of the thumb toward the upper end of the work enclosure.

In a fourth implementation, the present disclosure is directed to a method of washing all five digits of a human hand. The method includes: providing the work enclosure of the third implementation; providing temperature-controlled water to the spray nozzle of the work enclosure so that the inlet water pressure of the spray nozzle is at least 20 pounds per square inch, the outlet flow rate is at least 0.7 gallons per minute and the nozzle exit velocity is at least 45 feet per second; holding the work enclosure in a substantially upright orientation; inserting, simultaneously with one another and through the elongate finger-receiving region, the four three-phalanx digits into the interior space in the closed-fingered, upwardly curled arrangement while providing the temperature-controlled water to the spray nozzle; allowing the spray of water to impact upon the four three-phalanx digits for a period of time; removing the four three-phalanx digits from the interior space; inserting the opposing thumb into the interior space via the thumb notch so that the tip of the opposing thumb is pointing substantially toward the upper end of the work enclosure while providing the temperature-controlled water is provided to the spray nozzle; allowing the spray of water to impact upon the opposing thumb for a period of time; removing the opposing thumb from the interior space; and stopping flow of the temperature-controlled water to the enclosure.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DETAILED DESCRIPTION

The present disclosure is directed to water-powered hand-washing systems and components therefor that provides significant advantages over conventional water-based hand-washing devices known to the present inventor. Important among these advantages is the fact that a hand-washing system of the present disclosure provides excellent cleaning effectiveness, especially in the ability to dislodge and remove large fractions of bacteria and other foreign matter from fingernail beds and cuticular regions of fingers and thumbs with relatively little effort on the user's part, as compared to conventional cleaning methods, such as scrubbing with a nail brush. Another important advantage is that this cleaning effectiveness can be achieved at conventional domestic water supply pressures, for example, from about 20 pounds per square inch (PSI) to about 50 PSI. Other important advantages and improvements over conventional hand-washing devices, systems and methods will become apparent upon reading the following disclosure.

Figure 1:
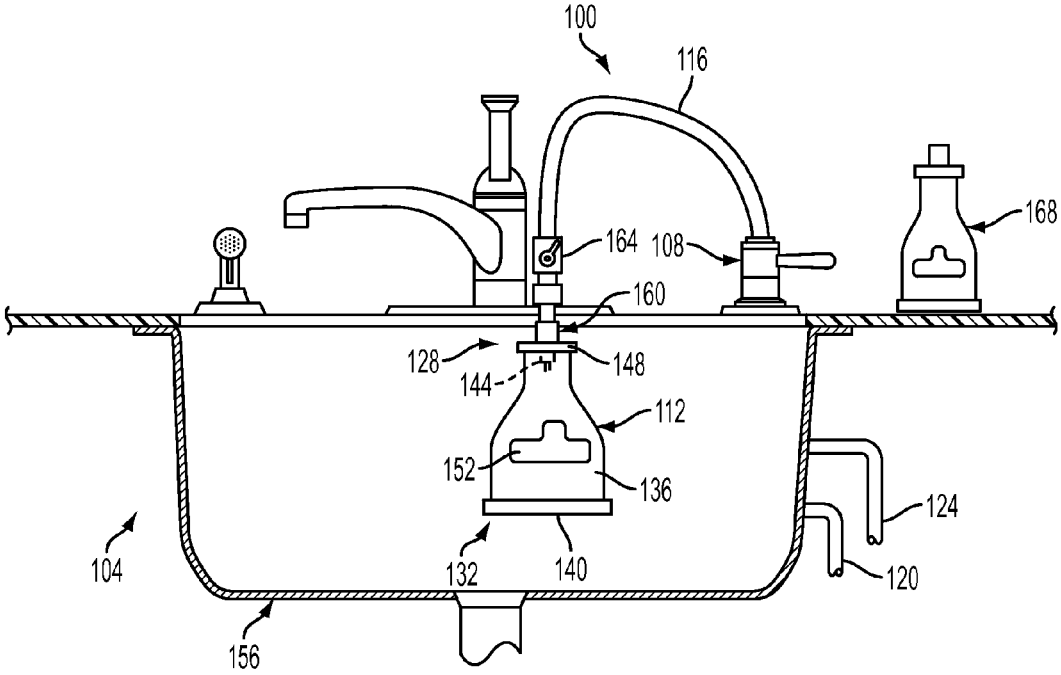
FIG. 1 is a partial cross-sectional view/partial elevational view of a water-powered hand-washing system installed in a household kitchen sink setting.

Turning now to the drawings, FIG. 1 illustrates an example of a water-powered hand-washing system 100 made in accordance with broad concepts disclosed herein. In this example, hand-washing system 100 is shown in a home-kitchen environment wherein it is integrated into a kitchen-sink installation 104. As such, hand-washing system 100 is readily available for use by virtually all members of the corresponding household, except perhaps for the very youngest of children. Installing a hand-washing system of the present disclosure in a central location, such as in a kitchen, is desirable because in some embodiments an important aspect of the system is that it be used routinely by all members of the household throughout the day, especially following any activity, such as gardening and preparing meals from raw meat, in which fingernail beds and cuticular regions become particularly dirty and/or are exposed to bacteria-laden/bacteria-promoting matter and especially before engaging in an activity, such as eating and dental flossing, where any bacteria and/or other undesirable matter present in fingernail beds and cuticular regions could easily enter a human body.

As those skilled in the art will readily appreciate, a home-kitchen environment, such as installation 104 of FIG. 1, is only one example of a location suitable for containing a water-powered hand-washing system made in accordance with one or more of the broad concepts of the present disclosure. Other examples of environments where installation of a system of the present disclosure would be beneficial include, but are not limited to, commercial kitchen environments to assist in the cleaning of hands of cooks and other food handlers so as to inhibit the spread of bacteria and other undesirable matter among food items and work areas, and health care environments to assist surgeons, physician's assistants and nurses in preparing for surgery or providing hands-on patient care so as to reduce the likelihood of contaminating the patient and risking infection. Indeed, and as described below, some of the broad concepts of the present disclosure are directed to features that will contribute to the efficacy of such systems not only in home and kitchen use, but in use in surgical settings where the cleanliness requirements are much more critical. Some or all of these features are lacking in various ones of conventional finger/thumb/hand cleaning assistance devices of which the present inventor is aware.

With continuing reference to FIG. 1, primary components of hand-washing system 100 include a mixing/flow valve 108, a work enclosure 112 and a flexible conduit 116 that fluidly connects the work enclosure to the mixing valve. Mixing/flow valve 108 is fluidly connected to each of a cold water supply line 120 and a hot water supply line 124, which may be any conventional domestic water supply lines, such as half-inch household lines that typically deliver a maximum of 1.8 gallons per minute (GPM) (California plumbing regulations) to 2.5 GPM (the rest of the U.S.) within a range of 20 PSI to 60 PSI. Typically, the hydrostatic pressure available in household water lines ranges from 20 PSI to 50 PSI, with an average range of about 35 PSI to 45 PSI in most municipal lines and 35 PSI to 40 PSI in most well or domestic, pump-driven lines.

When in use, mixing/flow valve 108 mixes cold and hot water from, respectively, cold and hot water supply lines 120, 124 so as to provide a desired/suitable temperature to the mixed output water, which flexible conduit 116 then provides to work enclosure 112. A thermostatic cartridge with mixing/flow valve 108 can protect users from scalding by limiting the maximum hot water temperature provided. Mixing/flow valve 108 also allows a user to adjust the flow of water provided to work enclosure 112 so as to optimize the cleaning conditions and user comfort of the spray within the enclosure. Mixing/flow valve 108 may be any suitable mixing valve. An example of a suitable mixing valve is the mixing valve portion of the Kohler® HIRise™ sidespray unit model K-7344-4, available from Kohler Company, Kohler, Wis. Of course, that unit would have to be modified to receive flexible conduit 116 rather than the sidespray assembly accompanying the valve. In a particular example, the modified unit includes flexible conduit 116 in a length of 28 inches measured from the base at the countertop to the shutoff valve (164). Of course, any one of many other mixing valves could be used. A constraint on the choice of mixing valves for use as mixing valve 108 is that the selected valve must be able to provide the water pressures and flow rates described below that are needed to provide hand-washing system 100 with it cleaning effectiveness.

As will become apparent from reading the following description, during use work enclosure 112 is designed to be oriented as shown in FIG. 1. As such, during use work enclosure 112 has an upper end 128 and a lower end 132. Primary components of work enclosure 112 include a sidewall 136, a bottom closure 140 and a spray nozzle 144. In the example shown, the opening formed by sidewall 136 at upper end 128 of work enclosure 112 is larger than the diameter of spray nozzle 144. Consequently, this example includes a top closure 148 to close the region between nozzle 144 and sidewall 136 so as to prevent backspray from exiting upper end 128 of work enclosure 112. In other embodiments, the upper end of the sidewall and corresponding spray nozzle may be designed so that the interface between the nozzle and sidewall obviates the need for any additional closure at the upper end of the work enclosure. Sidewall 136 includes a "digit" portal 152 ("digit" referring to the digits of a human hand, i.e., the fingers and thumb) that allows a user to insert one thumb or four fingers into the interior of work enclosure 112 in a proper manner (see below). Further details of work enclosure 112 are described below in connection with FIGS. 2-4.

Figure 2:
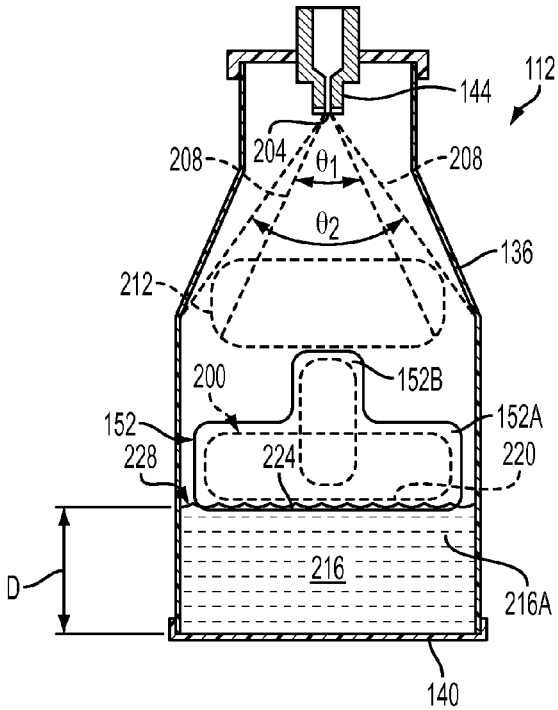
FIG. 2 is an enlarged vertical cross-sectional view of the work enclosure of the water-powered hand-washing system of FIG. 1.

Referring now to FIG. 2, work enclosure 112 is configured to receive the proximal, intermediate and distal phalanges of all four fingers simultaneously so that these four fingers can be cleaned substantially simultaneously with one another. To facilitate this simultaneity, digit portal 152 includes a laterally elongate finger-receiving slot 152A sized to accommodate these four fingers up to and including their proximate phalanges when these fingers are in loose contact with one another and inserted into work enclosure 112 in an upwardly curled manner as illustrated by finger 300 in FIG. 3. In this work position, the intermediate and distal phalanges of these four fingers are wholly contained within work enclosure 112. It is noted that in alternative embodiments in which all three phalanges of all four fingers may be inserted into the work enclosure at once, the work enclosure may be configured so that the user inserts his hand more than or less than shown in FIG. 3. For example, in some other embodiments the work enclosure may be configured for the user to insert their hand up to or past the metacarpophalangeal joints of those four fingers. Some other embodiments may be configured for the user to insert those four fingers only to their intermediate phalanges or their proximal interphalangeal joints.

Figure 3:
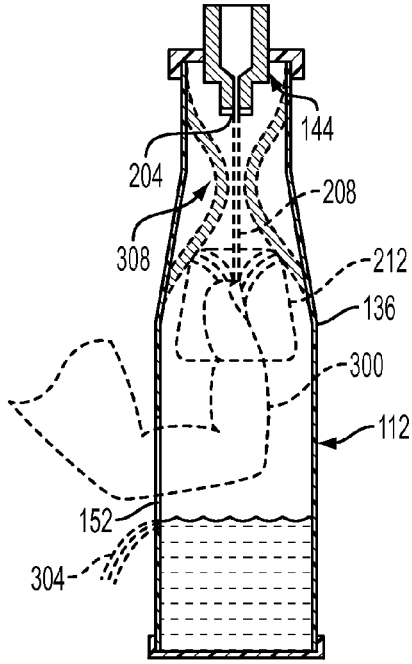
FIG. 3 is an enlarged vertical cross-sectional view of the work enclosure of FIG. 1 illustrating an orientation of a finger inserted into the work enclosure for cleaning.

Referring back to FIG. 2, dashed line 200 indicates the periphery of the approximate space occupied by the portion of the hand (here, the proximal phalangeal portion) that extends through digit portal 152 when an adult hand of 95-percentile breadth (e.g., 3.9 in. (9.8 cm) based on U.S. statistics) is properly positioned relative to work enclosure 112. In the example of FIGS. 1-3, when the four three-phalanx fingers of one of the user's hands are inserted in an upwardly curled manner as illustrated in FIG. 3, the user may be holding work enclosure 112 with the opposite hand by, for example, grasping the necked-down upper portion of the enclosure with the thumb and index and middle fingers. In alternative embodiments, the work enclosure could be secured to a fixture (not shown) or freestanding.

Spray nozzle 144 is either designed or selected to provide high volumetric flow rates and high outlet velocities across a range of delivery pressures. In the example shown, spray nozzle 144 has an outlet orifice 204 configured to provide a fan-shaped spray pattern 208, which is an effective shape because of the generally linear arrangement of the tips of the four three-phalanx fingers when they are in their work position as described above. The magnitude of included-angle θ (theta) may be selected based on the distance of the fingertip-receiving region (denoted by its outline 212) within work enclosure 112 from spray nozzle 144 (here, about 1.5 inches to 2 inches). The four fingers, once inserted, are moved side-to-side (here, about 0.75 inches to about 1 inch) to expose all surfaces to the full force of the high-velocity, high-flow-rate stream from spray nozzle 144. Based on the configuration of work enclosure 112 and working position of the hand within the enclosure, an acceptable included angle θ would generally fall in a range of about 30° ($\theta_1$) to about 60° ($\theta_2$). In other embodiments having configurations different from the configuration of work enclosure 112, the included angle of the corresponding spray patterns may be outside the range shown.

As seen in FIG. 3, in the direction perpendicular to the fan shape, spray pattern 208 remains fairly concentrated. That is, spray pattern 208 has very little spread as the spray moves away from outlet orifice 204. This narrowness allows the force of the spray to be as concentrated as possible in the fingertip-receiving region 212 where the user's digit tips will be located during cleaning. With spray pattern 208 remaining fixed and being relatively narrow in a plane perpendicular to the planes in which the fingers are positioned while present inside work enclosure 112 (i.e., the vertical plane into and out of the page containing FIG. 3), it can be appreciated that for the user to achieve the best cleaning results the user should slowly flex and extend the fingers and move them side-to-side (again, about 0.75 inches to about 1 inch in this example) to expose palmar surfaces, fingernail beds, cuticular regions and lateral surfaces to the spray for an effective amount of time (such as 30 seconds to 40 seconds or more).

Figure 4:
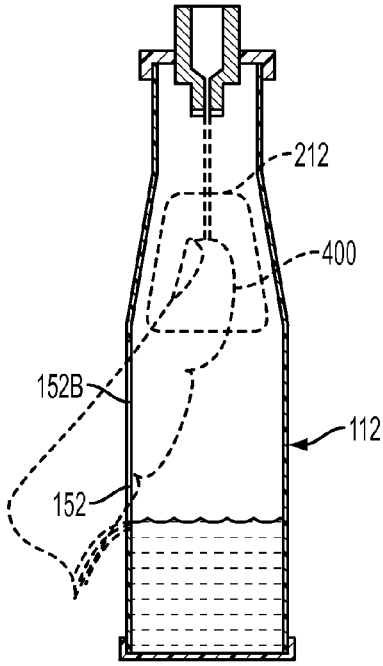
FIG. 4 is an enlarged vertical cross-sectional view of the work enclosure of FIG. 1 illustrating an orientation of a thumb inserted into the work enclosure for cleaning.

Referring again to FIG. 2, and also to FIG. 4, this example of digit portal 152 further includes a thumb notch 152B designed to accommodate the user's thumb 400 (FIG. 4) during washing. FIG. 4 illustrates one way that the user can insert thumb 400 into work enclosure 112, i.e., with the thumbnail generally facing the "front" of the work enclosure. Alternatively, the thumb may be inserted with the thumbnail facing the "back" of work enclosure 112. In either position the thumb can be gently flexed or extended to provide thorough exposure of the palmar surface, fingernail bed, cuticular surface and lateral surfaces to the spray for an effective amount of time (e.g., 20 seconds total or more). The choice of thumb orientation will generally depend on factors such as the location/locatability of work enclosure 112 relative to the user during washing and whether or not the user is holding the work enclosure with the opposite hand during washing.

With thumb 400 being generally more limited in terms of range-of-motion and positionability relative to the three-phalanx fingers, thumb notch 152B allows the user to position the tip of the thumb in fingertip-receiving region 212 where the tips of the three-phalanx fingers are located during washing. When thumb 400 is inserted into work enclosure 212 as shown in FIG. 4, the particular configuration of this work enclosure has roughly the entire distal phalanx of the thumb located within the enclosure. In other embodiments, it may be necessary to design the work enclosure so that some or most of the proximal phalanx of thumb 400 is also located within the enclosure. When thumb 400 of the user's one hand is inserted into work enclosure 112 as shown in FIG. 4, the user may be holding the work enclosure with the other hand, for example, as described above relative to the washing of the four three-phalanx fingers. Alternatively, work enclosure 112 may be secure to a fixture or free-standing.

As mentioned above, a hallmark of a water-powered hand-washing system of the present disclosure is the exposing of finger tips, especially the palmar surfaces, fingernail beds and cuticular regions, to high-impact-energy, high-flow-rate water spray. To this end, in a particular example suited for the particular configuration of working enclosure 112 shown in FIGS. 2-4 (with the various figures being largely in scale relative to finger 300 and thumb 400 of FIGS. 3 and 4, respectively), spray nozzle 144 is standard fan nozzle model ¼"NF1530 (30° fan) available from BETE Fog Nozzle, Inc., Greenfield, Mass. The ¼"NF1530 nozzle has the performance characteristics appearing in the following Table.

TABLE

Performance Characteristics of BETE 30° Fan Nozzle Model ¼"NF1530

| Inlet Pressure (P) (PSI) | Outlet Flow (Q) (GPM) | Exit Velocity (V) (ft/s (FPS)) | V/Q ((FPS)/(GPM)) |
|---|---|---|---|
| 10 | 0.75 | 34.7 | 46.3 |
| 20 | 1.06 | 49.0 | 46.2 |
| 30 | 1.30 | 60.1 | 46.2 |
| 40 | 1.50 | 69.4 | 46.3 |
| 50 | 1.68 | 77.5 | 46.1 |
| 60 | 1.84 | 85.2 | 46.3 |

The performance characteristics of the BETE®/¼"NF1530 spray nozzle listed in the preceding Table provide hand-washing system 100 (FIG. 1) with very good cleaning performance. Observations of test users have revealed that, with the BETE®/¼"NF1530 nozzle, its spray at an inlet pressure of about 20 PSI is well-tolerated by children. Adult test users have found its spray at about 35 PSI to about 50 PSI to be comfortable and invigorating. In this connection, it is noted that mixing/flow control valve 108 allows users to adjust the spray output by spray nozzle 144 to a comfortable, yet effective level, generally between about 10 PSI (0.75 GPM for the BETE® ¼"NF1530 nozzle) to about 58 PSI (1.8 GPM for the BETE®/¼"NF1530 spray nozzle (again, 1.8 GPM is the current maximum flow rate under California standards)). Operation at pressures higher than 58 PSI with the BETE®/¼"NF1530 spray nozzle is possible depending on code regulations (such as the 2.5 GPM maximum in U.S. states other than California) and whether a particular user can tolerate the resulting higher spray velocities.

As mentioned above, the cleaning effectiveness of hand-washing system 100 is due in large part to dilution and debridement accomplished by subjecting the target digit(s) to both high water flow (dilution) and high-impact water velocity (debridement). Regarding water flow rates, it is desired that the flow rate be at least about 0.75 GPM and more preferably at least about 1.3 GPM, with values up to 1.8 GPM (California standard) or 2.5 GPM (non-California states' standard) typically being more desirable as long as the resulting higher velocities are tolerable by a particular user. Regarding nozzle exit velocity, which correlates with impact force of the spray upon the digit(s) placed in fingertip-receiving region 212 (FIGS. 2-4), it is desirable that the exit velocity be at least about 40 feet per second (FPS) during cleaning, regardless of outlet flow rate or inlet pressure. For adults having the digit closest to the exit orifice of nozzle 144 about 1.5 inches to 2 inches from exit orifice 204, the exit velocity is more preferably at least about 60 FPS.

A convenient way to express the relationship between exit velocity (V) and outlet flow (Q) for any nozzle is to calculate the V/Q ratio. As seen from the Table above, for the BETE® ¼"NF1530 spray nozzle the V/Q ratio is largely constant, here about 46.3 FPS/GPM, over the range of inlet pressures appearing in the Table. It is recognized that water spray nozzles suitable for use as nozzle 144 other than the BETE®/¼"NF1530 nozzle will have performance characteristics different from the performance characteristics of the ¼"NF1530 nozzle presented in the Table above. For example, not only can the V/Q ratio be different, but the outlet flow rates Q and exit velocities at particular pressures can be different, too. For example, a suitable alternative nozzle may provide a flow rate of 1.6 GPM at 30 PSI and have a corresponding outlet velocity of 70 FPS (here, V/Q would be about 43.8 FPS/GPM. Regardless of the nozzle used, it is beneficial for the V/Q ratio, when V is expressed in FPS and Q is expressed in GPM, to be at least about 20 FPS/GPM and more preferably at least about 30 FPS/GPM.

When hand-washing system 100 (FIG. 1) is operating within the intended ranges of flow rates and velocities, the water output of nozzle 144 can be equated to output of a conventional garden-hose nozzle outputting 1.8 GPM in a fairly tightly focused pattern at a line-pressure of 45 PSI. As one can imagine, the output rate and forcefulness of spray nozzle 144 is quite substantial, especially for a device intended for use inside homes, in commercial kitchens and in surgical scrub areas, among other places. In this connection and referring again to FIG. 2, work enclosure 112 includes an energy-dissipation region 216 that, during use, defines an energy-dissipating reservoir of water 216A for rapidly dissipating energy in the high-velocity water spray from nozzle 144 during use, both when one or more digits are properly inserted into the work enclosure and being washed and when the nozzle is spraying water without any digits present within the work enclosure. The latter situation can occur if the nozzle is still operating but the user does not have any digits inside enclosure 112, such as just before or just after a washing operation.

As seen in FIG. 2, dashed line 220 indicates that when a hand is properly engaged with work enclosure 112, a gap exists between the lower edge 224 of sidewall 136 and the hand-occupied region of digit portal 152. FIG. 3 illustrates that when hand-cleaning system 100 is operating, this configuration allows reduced-energy water 304 to fairly gently exit work enclosure 112 and fall to a suitable location, such as a sink, for example, sink 156 of FIG. 1, without interfering with the insertion or removal of any of the digits during a cleaning operation. It is noted that in alternative embodiments, bottom closure 140 and/or sidewall 136 near lower end 132 can each be provided with one or more apertures to partially or fully handle the outflow of water from within work enclosure 112 during use. That said, for the sake of easily maintaining the cleanness of work enclosure 112, the fewer apertures, especially relatively small apertures having reentrant corners/small radii, the better, since contaminants tend to build up in such areas, even with moderate cleaning.

A large part of the energy-dissipation capability of energy-dissipation region 216 is due to the depth D of the pool 228 of water that eventually collects in the energy-dissipation region. Depth D should be great enough that the force of the spray striking pool 228 at full spray without any digits present within enclosure 112 does not part water 228 all the way to bottom closure 140. For the BETE® 30° ¼"NF1530 nozzle described above, an adequate depth D that provides ample energy dissipation is about 1.5 inches. Somewhat lesser depths could likely be tolerated, as could greater depths. If additional apertures are provided to work enclosure 112 as mentioned above, care should be taken to avoid placing them in the direct path of spray pattern 208 if they are un-baffled because the spray will tend to exit the work enclosure forcefully through such apertures until enough depth has built up in pool 228.

FIG. 3 illustrates two configurations of sidewall 136 near spray nozzle 144. The first configuration (shown in solid lines) is a straightforward configuration that includes a gentle tapering of sidewall 136 from its widest region (relative to the view of FIG. 3) near digit portal 152 to its narrowest region near nozzle 144. The second configuration (shown in dashed lines) includes a "pinched" region 308 near nozzle 144 that inhibits backsplashing from the impact of the spray issued by the nozzle upon one or more digits present in fingertip-receiving region 212. By inhibiting such backsplash, contamination of nozzle 144 and regions immediately surrounding the nozzle can be reduced.

Further regarding the cleanness of work enclosure 112, several features of this enclosure provide it with excellent cleanability. In surgical and other patient-care settings, it is likely that work enclosure 112 will be sterilized between uses or top closure 148 with nozzle 144 and the female portion of quick-disconnect assembly (160) will be sterilized and the lower work enclosure (here, sidewall 136 and bottom closure 140) disposable. In the home setting there are several features that facilitate disassembly and cleaning, including: 1) readily removable bottom and top closures 140, 148 (FIG. 1); 2) smooth interior to sidewall 136 that contains few, to no, reentrant corners and other contaminant-trapping structures; 3) simply shaped sidewall that allows easy access to all internal surfaces of the sidewall by, for example, a bottle brush and 4) simply shaped internally facing surfaces of the bottom and top closures.

Regarding materials of construction of the various components of work enclosure 112, each of the components may be made of any material(s) suitable for that component. For example, sidewall 136 may be made of metal, plastic or composite, or any combination thereof, as may be bottom and top closures 140, 148. Likewise, nozzle 144 may be made of metal, plastic or composite, or any combination thereof. Considerations for selecting materials include strength, weight, durability and cost, among others.

Referring again to FIG. 1, in this example hand-washing system 100 includes a quick-disconnect assembly 160 and a shutoff valve 164 that provide the system with great flexibility. The combination of these two elements allows work enclosure 112 to be quickly and easily coupled to and decoupled from flexible conduit 116 for any of a variety of reasons without having to change the setting on mixing/flow valve 108. For example, if hand-washing system 100 includes a second work enclosure, such as child-sized work enclosure 168 (whereas work enclosure 112 is an adult-sized work enclosure), a user could readily switch between the differing work enclosures. In this example, it is noted that work enclosure 168 has all of the features of work enclosure 112, but is sized for smaller hands, such as hands of young children.

Quick-disconnect assembly 160 can be any suitable quick-disconnect assembly, such as a quick-disconnect assembly that includes a suitable combination of male and female couplings, for example, the male and female quick-disconnect couplings available from McMaster-Carr, Atlanta, Ga. Those skilled in the art will readily appreciate that the variety of quick-disconnect couplings is large and the choice of these couplings will depend on things such as the configuration of nozzle 144 (e.g., interiorly, exteriorly threaded, barbed, etc.), the configuration of the immediately adjacent upstream component (here, shutoff valve 164) (e.g., interiorly, exteriorly threaded, barbed, etc.) and design choice.

Similarly, shutoff valve 164 can be any suitable shutoff valve, such as a simple ball valve or stop cock. In other, more elaborate embodiments, the shutoff valve (if provided) can be a lever-type valve of the type commonly found on commercial kitchen utility spray assemblies adjacent the spray heads. An example of such a spray valve having a lever-type valve is the FIS-2946 spray valve available from Fisher Manufacturing Company, Tulare, Calif. It is noted that shutoff valve 164 need not be provided. In such embodiments, if having a water shutoff feature independent of mixing/flow valve 108 is desired, for example, for swapping work enclosures 112, 168 with one another, a type of quick-disconnect valve that shuts off flow when the male and female components are disconnected from one another may be used.

Figure 5:
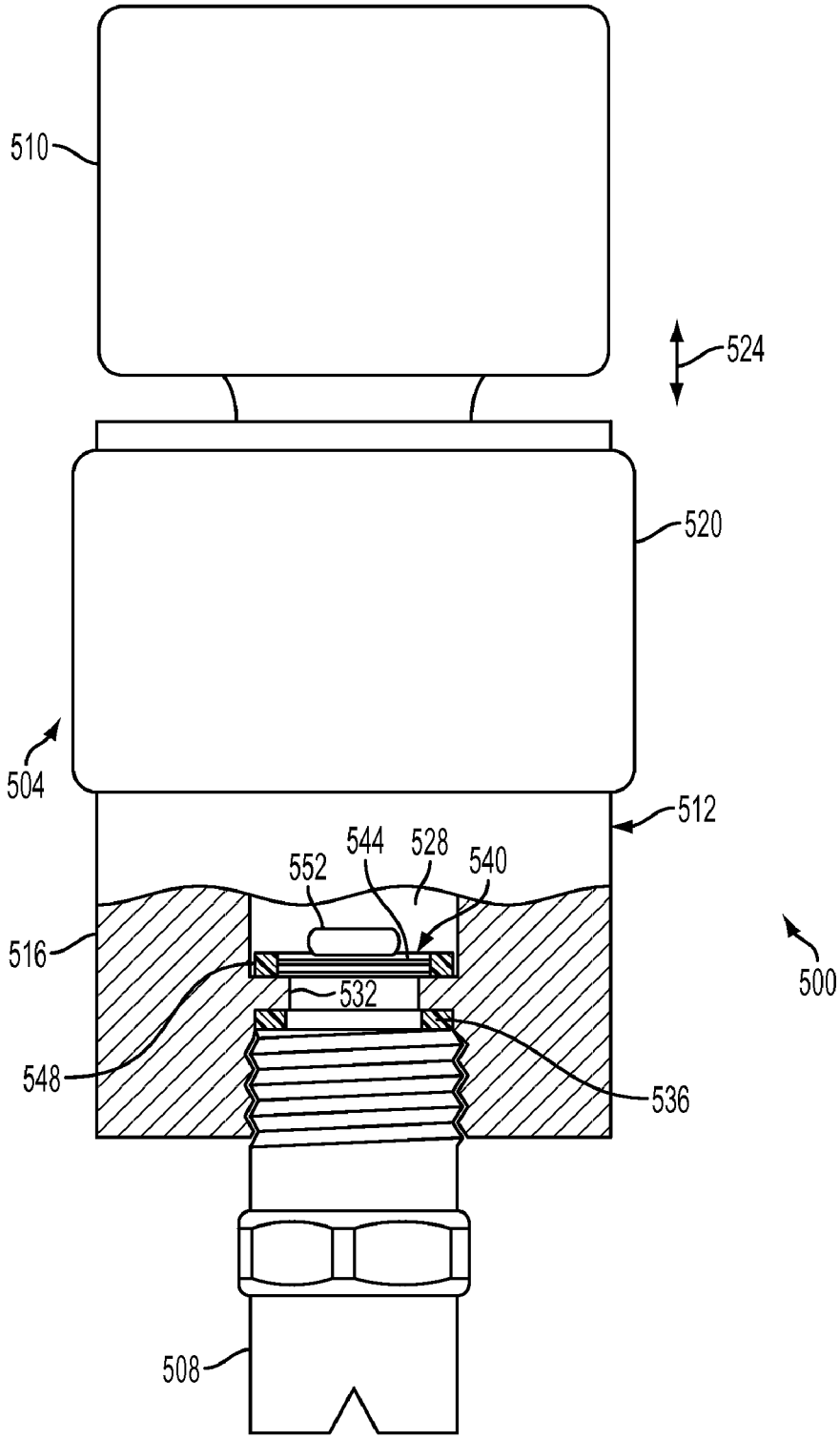
FIG. 5 is an enlarged partial cross-sectional view/partial elevational view of a quick-disconnect coupler/nozzle assembly configured to receive a pill for dispensing a washing agent to a work enclosure of a water-powered hand washer, such as either of the work enclosures of FIG. 1, when the assembly is coupled to such an enclosure.

FIG. 5 illustrates a particular quick-disconnect assembly/nozzle arrangement 500 that can be used with a work-enclosure made in accordance with the broad concepts described above, such as either of work enclosures 112, 168 of FIG. 1. Quick-disconnect assembly/nozzle arrangement 500 allows a user to enhance the cleaning performance of a hand-washing system of the present invention by dispensing a washing agent (e.g., soap, detergent, sanitizer, etc., and any combination thereof) into the water flow that reaches the user's digit(s) present in the work enclosure (not shown). In this example, quick-disconnect assembly/nozzle arrangement 500 comprises a quick-disconnect assembly 504 and a spray nozzle 508. Quick-disconnect assembly 504 includes a male coupling 510 and a female coupling 512 that removably engage one another in a conventional manner. In this example, female coupling 512 includes a body 516 and a sleeve 520 that is movable longitudinally relative to the body. When a user desires to uncouple male and female couplings 508, 512 from one another, the user moves sleeve 520 in the appropriate direction so as to initiate the disengaging process. Arrows 524 indicate the directions of movement of male coupling 510 during engagement and disengagement of the male coupling relative to female coupling 512 (assuming female coupling is fixed in space). Alternatively, some designs permit uncoupling to be initiated by a convenient button on the side of the female component. The Standard Push-Button Socket model no. 5163T11, available from McMaster-Carr, displays this feature.

In this example, body 516 of female coupling 512 includes a longitudinal central passageway 528 and an integral annular stop 532. Stop 532 provides a first shoulder for engaging a sealing gasket 536 between female coupling 516 and spray nozzle 508 and a second shoulder for engaging a screen assembly 540. Here, screen assembly 540 includes a screen 544 and an annular resilient gasket 548 that has a slight interference fit with passageway 528 so as to hold the assembly in place within the passageway. In this example, the washing-agent dispensing feature is implemented by a user inserting a washing-agent pellet or pill 552 into passageway 528 upstream of screen assembly 540. It is noted that the word "pill" is used herein and in the appended claims for convenience to denote both a self-contained mass of one or more pure washing agents and a self-contained mass of one or more pure washing agents in combination with one or more fillers, one or more binding agents, one or more additives, and/or a containment structure (e.g., a gel capsule), and any combination thereof. Pill 552 should have an appropriate shape that does not significantly impact the flow rate through female coupling 516.

In a typical scenario, a user inserts washing-agent pill 552 into passageway 528 by disengaging male coupling 510 from female coupling 512, places the pill into the passageway and re-engages the male coupling with the female coupling. During operation of the hand-washing system of which quick-disconnect assembly/nozzle arrangement 500 is made a part, water (not shown) flowing through passageway 528 slowly dissolves washing-agent pill 552 and causes the output (not shown) of spray nozzle 508 to contain the dissolved portion of the pill. In one embodiment, pill 552 is designed to dissolve in an amount of time equal to, or roughly equal to, the amount of time anticipated for a typical wash cycle, either for one hand or both hands, as desired. Other types of washing-agent dispensing arrangements are possible, such as an arrangement that uses a venturi eductor to draw a washing agent into the water flow before it is ejected into the work enclosure. Those skilled in the art will understand how to provide such alternative washing-agent dispensing arrangements to a hand-washing system made in accordance with the present disclosure.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A hand-washing system powered by water, comprising:
a work enclosure that includes:
an upper end when said work enclosure is in use;
a lower end when said work enclosure is in use, said lower end spaced from said upper end and defining an energy dissipation region for containing water having a first depth;
a longitudinal central axis extending between said upper end and said lower end;
a sidewall extending between said upper end and said lower end;
a closure substantially closing said lower end;
an interior space substantially defined by said sidewall and said closure; and
a spray nozzle located at said upper end, said spray nozzle having an inlet, an inlet water pressure at said inlet during use, and a spray exit orifice configured to provide a spray of water at an outlet flow rate (Q) and a nozzle exit velocity (V) during use, said spray nozzle configured so that 1) the outlet flow rate is at least 0.7 gallons per minute when the inlet water pressure is 20 pounds per square inch and 2) said spray nozzle has a V/Q ratio of at least 20 gallons-per-minute per feet-per-second, wherein said spray exit orifice is oriented to direct the spray of water into said interior space;
wherein said sidewall contains a digit portal receiving at least one digit of a hand of a human user during use, said digit portal in fluid communication with said energy dissipation region and spaced from said closure along said longitudinal central axis so that water present in said energy dissipation region in excess of said first depth may flow out of said interior space through said digit portal, further wherein said digit portal is positioned in said sidewall along said longitudinal central axis and said spray nozzle is configured so that said first depth of said water in said energy dissipation region is sufficient, when said at least one digit is not present in said interior space, to preclude said spray of water from said spray nozzle from parting water present in said reservoir of said energy dissipation region deeply enough to reach said closure when said inlet water pressure is less than 60 pounds per square inch.

2. The hand-washing system according to claim 1, wherein said spray nozzle is configured so that 1) the outlet flow rate is at least 0.7 gallons per minute when the inlet water pressure is 20 pounds per square inch and 2) said ,Spray nozzle has a V/Q ratio of at least 30 gallons-per-minute per feet-per-second.

3. The hand-washing system according to claim 1, wherein said spray nozzle is configured so that 1) the outlet flow rate is at least 1.5 gallons per minute when the inlet water pressure is 40 pounds per square inch and 2) said spray nozzle has a V/Q ratio of at least 30 gallons-per-minute per feet-per-second.

4. The hand-washing system according to claim 3, wherein said spray nozzle is configured so that the nozzle exit velocity is at least 65 feet per second when the inlet water pressure is 50 pounds per square inch.

5. The hand-washing system according to claim 1, wherein said spray exit orifice is configured to provide a fan-shaped spray having an included angle of at least 25°.

6. The hand-washing system according to claim 1, wherein the hand includes four fingers and an opposing thumb and said digit portal is configured to receive the four fingers simultaneously in a closed-finger, upwardly curled arrangement.

7. The hand-washing system according to claim 6, wherein said digit portal is substantially rectangular and elongate in a circumferential direction relative to said longitudinal central axis.

8. The hand-washing system according to claim 7, wherein said digit portal includes a thumb notch extending toward said upper end of said work enclosure, said thumb notch for receiving the thumb in an orientation that allows the human user to point the tip of the thumb toward said upper end of the work enclosure.

9. The hand-washing system according to claim 6, wherein each of the four fingers includes a proximal phalanx, an intermediate phalanx and a distal phalanx, and when the four fingers are properly inserted into said work enclosure through said digit portal, the proximal phalanx of each of the four fingers extends through said digit portal.

10. The hand-washing system according to claim 1, wherein said work enclosure contains a digit-tip-receiving region for receiving each tip of the at least one digit and said work enclosure includes a constriction located between said digit-tip-receiving region and said spray nozzle for inhibiting back-spray, toward said spray nozzle, from the spray of water striking the tip of the at least one digit when the tip is located at said digit-tip-receiving region when the hand-washing system is in use.

11. The hand-washing system according to claim 10, wherein said sidewall has a substantially uniform thickness and said constriction is formed by a pinched region of said work enclosure.

12. The hand-washing system according to claim 1, further comprising a mixing valve fluidly coupled to said spray nozzle, said mixing valve for receiving hot and cold water, mixing the hot and cold water into a controlled-temperature mixture and providing the controlled-temperature mixture to said spray nozzle, wherein said mixing valve includes a thermostatic cartridge for protecting a user from scalding.

13. The hand-washing system of claim 12, wherein said mixing valve is a combined mixing valve/flow valve.

14. The hand-washing system according to claim 12, further comprising a flexible conduit fluidly coupling said spray nozzle to said mixing valve.

15. The hand-washing system according to claim 14, further comprising a shutoff valve fluidly coupled between said mixing valve and said spray nozzle.

16. The hand-washing system according to claim 14, further comprising a quick-disconnect assembly fluidly coupled between said flexible conduit and said spray nozzle.

17. The hand-washing system according to claim 16, wherein said quick-disconnect assembly includes a female quick-disconnect coupling configured to receive and retain a dissolvable washing-agent pill.

18. The hand-washing system of claim 1, wherein said digit portal is spaced from said closure so as to define an energy dissipation region for containing a reservoir of water for dissipating energy in the spray of water when the hand-washing system is operating in an upright position with said upper end located above said lower end.

19. The hand-washing system according to claim 18, wherein the reservoir has a single outflow during use of the hand-washing system, the single outflow being through said digit portal.

20. The hand-washing system according to claim 19, wherein said digit portal is spaced from said closure by at least 1.5 inches so that the reservoir is at least about 1.5 inches deep during use of the hand-washing system.

21. A hand-washing system, comprising:

a first work enclosure arranged according to said work enclosure of claim 1 and configured to be optimized for a first hand of a first size, said first work enclosure including a first quick-disconnect coupling;

a second work enclosure arranged according to said work enclosure of claim 1 and configured to be optimized for a second hand of a second size different from the first size of the first hand, said second work enclosure including a second quick-disconnect coupling;

a mixing valve for receiving hot and cold water and mixing the hot and cold water into a controlled-temperature mixture;

a third quick-disconnect coupling; and a flexible conduit fluidly connecting said third quick-disconnect coupling to said mixing valve;

wherein each of said first and second quick-disconnect couplings is configured to fluidly couple, in seriatim, corresponding respective ones of said first and second work enclosures to said third quick-disconnect coupling so as provide the controlled temperature mixture thereto.

22. The hand-washing system according to claim 21, wherein said first work enclosure is configured to be optimized for an adult-size hand and said second work enclosure is configured to be optimized for a child-size hand.

23. The hand-washing system according to claim 21, wherein each of said first and second work enclosures includes a digit portal, wherein said digit portal is substantially rectangular and elongate in a circumferential direction relative to a longitudinal central axis of said first and said second work enclosures, and further wherein the first hand and the second hand each include four fingers and an opposing thumb, said digit portal configured to receive the four fingers simultaneously in a closed-finger, upwardly curled arrangement.

24. The hand-washing system according to claim 23, wherein said digit portal includes a thumb notch extending toward an upper end of said first and said second work enclosures, said thumb notch for receiving the thumb in an orientation that allows a human user to point a tip of the thumb toward said upper end of the work enclosure.

25. The hand-washing system according to claim 21, wherein each of said first and second quick-disconnect couplings is configured to receive and retain a dissolvable washing-agent pill.

26. A water-powered hand-washing system for washing digits of a hand including four contiguous three-phalanx fingers and an opposing thumb, the water-powered hand-washing system comprising:

a work enclosure that includes:

an upper end when the hand-washing system is in use;

a lower end when the hand-washing system is in use, said lower end spaced from said upper end;

a longitudinal central axis extending between said upper end and said lower end;

a sidewall extending between said upper end and said lower end;

a closure substantially closing said lower end;

an interior space substantially defined by said sidewall and said closure; and a spray nozzle located at said upper end, said spray nozzle having an inlet, an inlet water pressure at said inlet, and a spray exit orifice configured to provide a spray of water at an outlet flow rate (Q) and a nozzle exit velocity (V), said spray nozzle configured so that the outlet flow rate is at least 1.5 gallons per minute when the inlet water pressure is 40 pounds per square inch and said spray nozzle has a V/Q ratio of at least 30 gallons-per-minute per feet-per-second, wherein said spray exit orifice is oriented to direct the spray of water into said interior space, said spray nozzle configured to provide a fan-shaped spray having an included angle of at least 25°;

wherein said sidewall contains a digit portal spaced from said closure so as to define an energy dissipation region for containing a reservoir of. water for dissipating energy in the spray of water when the hand-washing system is operating in an upright position with said upper end located above said lower end, said digit portal having a laterally elongate finger receiving-region for receiving simultaneously the four three-phalanx fingers in a closed-fingered, upwardly curled arrangement, and further having a thumb notch extending toward said upper end of said work enclosure, said thumb notch for receiving the thumb in an orientation that allows the human user to point the tip of the thumb toward said upper end of the work enclosure, further wherein said digit portal is defined by an upper edge extending transverse to said longitudinal central axis and spaced from said spray exit orifice along said longitudinal central axis so that when an adult hand of 95-percentile breadth is positioned in said digit portal so that inner surfaces of proximal phalanges of the four three-phalanx fingers engage said upper edge such that intermediate and distal phalanges of the four three-phalanx fingers are positioned in said upwardly curled arrangement, tips of the distal phalanges are spaced no more than two inches from said spray exit orifice.

* * * * *